US008733508B2

(12) United States Patent
Bacon

(10) Patent No.: US 8,733,508 B2
(45) Date of Patent: May 27, 2014

(54) SCISSOR LIFT ASSEMBLY

(75) Inventor: Todd J. Bacon, Northville, MI (US)

(73) Assignee: Herkules Equipment Corporation, Walled Lake, MI (US)

( * ) Notice: Subject to any disclaimer, the term of this patent is extended or adjusted under 35 U.S.C. 154(b) by 1058 days.

(21) Appl. No.: 12/753,614

(22) Filed: Apr. 2, 2010

(65) Prior Publication Data

US 2011/0240409 A1 Oct. 6, 2011

(51) Int. Cl.
*B66F 7/06* (2006.01)
*B66B 9/02* (2006.01)

(52) U.S. Cl.
CPC .. *B66F 7/065* (2013.01); *B66B 9/02* (2013.01)
USPC ..... 187/269; 187/240; 254/122; 248/421

(58) Field of Classification Search
CPC ..... B66B 11/06; B66B 9/02; B66B 9/025; B66B 11/04; B66F 7/06; B66F 7/065; B66F 7/0658; B66F 7/0675; F16M 13/00; A47B 9/00
USPC ..... 254/7 B, 7 R, 9 B, 9 R, 122, 126; 187/211, 240, 242, 269; 182/69.5; 248/421, 588; 108/145
See application file for complete search history.

(56) References Cited

U.S. PATENT DOCUMENTS 3,556,481 A * 1/1971 Mueller et al. ..... 254/122
3,614,065 A 10/1971 Adamski et al.
3,741,524 A 6/1973 Morgan et al.
3,892,142 A * 7/1975 Karls et al. ..... 74/521
3,901,356 A 8/1975 Butler
4,025,053 A 5/1977 Stickle, Jr.
4,219,186 A 8/1980 Brewer
4,427,093 A 1/1984 Wehmeyer et al.
4,533,106 A 8/1985 Stockl
(Continued)

FOREIGN PATENT DOCUMENTS

DE 3442940 A1 * 6/1986
EP 0501254 A2 2/1992
EP 2019076 A1 * 1/2009
JP 07267594 A * 10/1995

OTHER PUBLICATIONS

AIPN, Machine Translation, JP07267594A, Sep. 10, 2013 (JST), pp. 1-4.*
EPO, Machine Translation, DE3442940, Sep. 9, 2013, pp. 1-9.*
(Continued)

*Primary Examiner* — William A Rivera
*Assistant Examiner* — Stefan Kruer
(74) *Attorney, Agent, or Firm* — Howard & Howard Attorneys PLLC

(57) ABSTRACT

A lift assembly includes a base and a platform at a relatively greater distance from the base in an extended state than in a contracted state. The lift assembly includes a pair of scissor arms with each arm having opposed first and second ends, and pivotably connected to each other about a central axis. The lift assembly includes a drive screw mechanism including a shaft defining a longitudinal axis, and further includes a drive motor, a block, and a collar. The lift assembly further includes first and second pairs of links. Each link has opposed first and second ends and an edge facing away from the central axis and defining a recess in the link. The collar and block are spaced from the central axis and indirectly coupled to the pair of scissor arms through a pair of links.

10 Claims, 6 Drawing Sheets

(56) References Cited

U.S. PATENT DOCUMENTS

| | | | | | |
|---|---|---|---|---|---|
| 4,534,544 | A | | 8/1985 | Heide | |
| 4,549,721 | A | | 10/1985 | Stone | |
| 4,577,821 | A | | 3/1986 | Edmo et al. | |
| 4,619,346 | A | | 10/1986 | Deguerry | |
| 4,858,482 | A | | 8/1989 | Knudsen | |
| 4,872,800 | A | | 10/1989 | Gutov et al. | |
| 4,899,987 | A | | 2/1990 | Craig | |
| 4,905,496 | A | | 3/1990 | Venalainen | |
| 4,921,074 | A | | 5/1990 | Ochs | |
| 5,149,242 | A | | 9/1992 | Haymore | |
| 5,262,706 | A | * | 11/1993 | Hollingsworth | 318/560 |
| 5,285,992 | A | * | 2/1994 | Brown | 248/421 |
| 5,299,906 | A | | 4/1994 | Stone | |
| 5,322,143 | A | | 6/1994 | Curran | |
| 5,513,723 | A | | 5/1996 | Luebke | |
| 5,636,711 | A | | 6/1997 | Nussbaum | |
| 5,694,864 | A | * | 12/1997 | Langewellpott | 108/145 |
| 5,695,173 | A | | 12/1997 | Ochoa et al. | |
| 5,716,040 | A | | 2/1998 | Torres | |
| 5,722,513 | A | | 3/1998 | Rowan et al. | |
| 5,934,414 | A | | 8/1999 | Staczek | |
| 6,050,365 | A | | 4/2000 | Newlin | |
| 6,092,788 | A | | 7/2000 | Simon | |
| 6,257,372 | B1 | | 7/2001 | Schirmer | |
| 6,286,629 | B1 | | 9/2001 | Saunders | |
| 6,305,499 | B1 | | 10/2001 | Jones et al. | |
| 6,371,247 | B1 | | 4/2002 | Nedderman, Jr. | |
| 6,464,205 | B2 | | 10/2002 | Wanner | |
| 6,537,017 | B2 | | 3/2003 | Stone | |
| 6,591,945 | B1 | | 7/2003 | Kigawa et al. | |
| 6,601,826 | B1 | | 8/2003 | Grannata | |
| 6,619,433 | B1 | | 9/2003 | Robert et al. | |
| 6,634,462 | B2 | | 10/2003 | Byeong-Ho | |
| 6,640,934 | B1 | | 11/2003 | Edwards | |
| 6,651,775 | B2 | | 11/2003 | Bassett, Jr. | |
| 6,672,430 | B2 | | 1/2004 | Boucher et al. | |
| 6,679,479 | B1 | | 1/2004 | Watkins | |
| 6,705,238 | B1 | | 3/2004 | Heckert | |
| 6,742,768 | B2 | | 6/2004 | Alba | |
| 6,779,635 | B1 | | 8/2004 | Anibas | |
| 6,814,188 | B1 | | 11/2004 | Heckert | |
| 6,854,715 | B2 | | 2/2005 | Hicks et al. | |
| 6,910,677 | B1 | | 6/2005 | Miller et al. | |
| 7,070,167 | B1 | | 7/2006 | Bacon et al. | |
| 7,093,691 | B1 | | 8/2006 | Vaughan et al. | |
| 7,117,977 | B2 | | 10/2006 | Abe | |
| 7,213,686 | B2 | | 5/2007 | Kaufman | |
| 7,225,901 | B2 | | 6/2007 | Mustalahti et al. | |
| 7,331,425 | B2 | | 2/2008 | Bukowski et al. | |
| 7,383,923 | B2 | | 6/2008 | Patten et al. | |
| 7,413,056 | B2 | | 8/2008 | Gonzi et al. | |
| 7,461,722 | B2 | | 12/2008 | Kyotani | |
| 7,506,725 | B2 | | 3/2009 | Kuo et al. | |
| 2003/0047388 | A1 | | 3/2003 | Faltel | |
| 2004/0069979 | A1 | * | 4/2004 | Hicks et al. | 254/122 |
| 2006/0037518 | A1 | | 2/2006 | Lopez Alba | |
| 2006/0180403 | A1 | | 8/2006 | Hanlon | |
| 2008/0047068 | A1 | | 2/2008 | Zakrzewski | |
| 2008/0101905 | A1 | | 5/2008 | Morris et al. | |

OTHER PUBLICATIONS

English language translation of Abstract for European Patent Application No. 0501254A2, filed Feb. 28, 1991.

* cited by examiner

SCISSOR LIFT ASSEMBLY

BACKGROUND OF THE INVENTION

1. Field of the Invention

The present invention relates generally to belt-driven transportation systems, and particularly to such systems configured as lift assemblies and conveyor assemblies.

2. Description of the Related Art

Scissor-type lift assemblies are well known for moving its platform, which supports items or people, between two vertically differing locations as it moves between a lowered or contracted state and an elevated or extended state. It is known to drive such lift assemblies with screw-drive mechanisms. These prior lift assemblies, however, can be problematic in that they may undesirably require operating space that cannot be easily accommodated or interferes with carrying out the operation to which the system is applied. For example, some prior scissor-type life assemblies have platform heights in their fully contracted states that require the load to first be lifted a substantial vertical distance from the level of a floor, on which the base is positions, to place it on the platform. Thus, it would be preferably to minimize the height of the platform in its fully contracted or lowered state.

A scissor-type lift assembly that addresses this problem, and is configured to minimize the height of its load-supporting platform surface in its contracted or lowered state, is desirable.

SUMMARY OF THE INVENTION

The present invention provides a scissors-type lift assembly including a base and a platform, the lift assembly having extended and contracted states, with the platform at a relatively greater distance from the base in the extended state than in the contracted state. The lift assembly further includes a pair of scissor arms each having opposed first and second ends and pivotably connected to each other about a central axis located between their respective first and second ends. The first end of each scissor arm is coupled to the base, and the second end of each scissor arm is coupled to the platform. The lift assembly also has a drive screw mechanism that includes a shaft, a drive motor rotatably coupled to the shaft, a block threadedly engaged with the shaft, and a collar relative to which the shaft is rotatable. The block has longitudinal movement relative to the shaft urged by rotation of the shaft, and the collar is longitudinally fixed relative to the shaft. The lift assembly further includes first and second pairs of links, each link having opposed first and second ends between which extends an edge of link that faces away from the central axis and defines a recess in the link. The collar and the block are each spaced from the central axis and indirectly coupled to both of the pair of scissor arms through a pair of links, the links of each of the first and second pairs of links crossed between their respective first and second ends.

The configurations of the links through which the collar and block are connected to the scissor arms allows the scissor arms to fold relatively flatter in the lift assembly lowered or contracted state without substantial sacrifice of platform height in the elevated state. Any portion of the drive screw mechanism that would otherwise interfere with these links, were they instead straight, is provided with clearance that allows continued motion of the scissor arms.

There has thus been outlined, rather broadly, certain features of embodiments of the invention in order that the detailed descriptions thereof may be better understood, and in order that the present contribution to the art may be better appreciated. Additional or alternative features of embodiments of the invention are described in further detail below.

In this respect, before explaining embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

To accomplish the above and related objects, the invention may be embodied in the forms illustrated in the accompanying drawings, attention being called to the fact, however, that the drawings are illustrative only, and that changes may be made in the specific constructions illustrated. Moreover, it is to be noted that the accompanying drawings are not necessarily drawn to scale or to the same scale. In particular, the scale of some of the elements of the drawings may be exaggerated to emphasize characteristics of the elements.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

Figure 1:
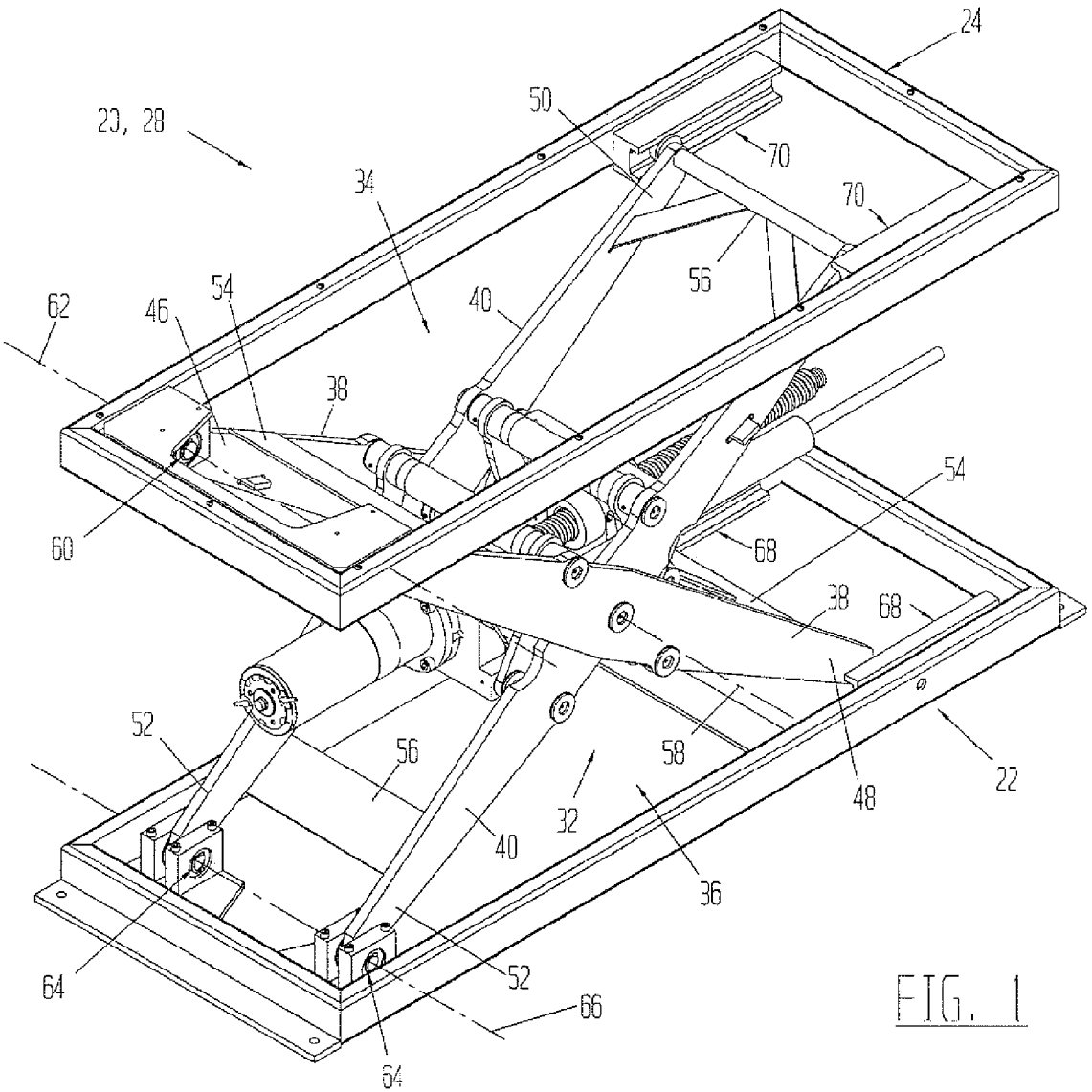
FIG. 1 is a perspective view of an embodiment of a scissor-type lift assembly in an elevated state.
Figure 2:
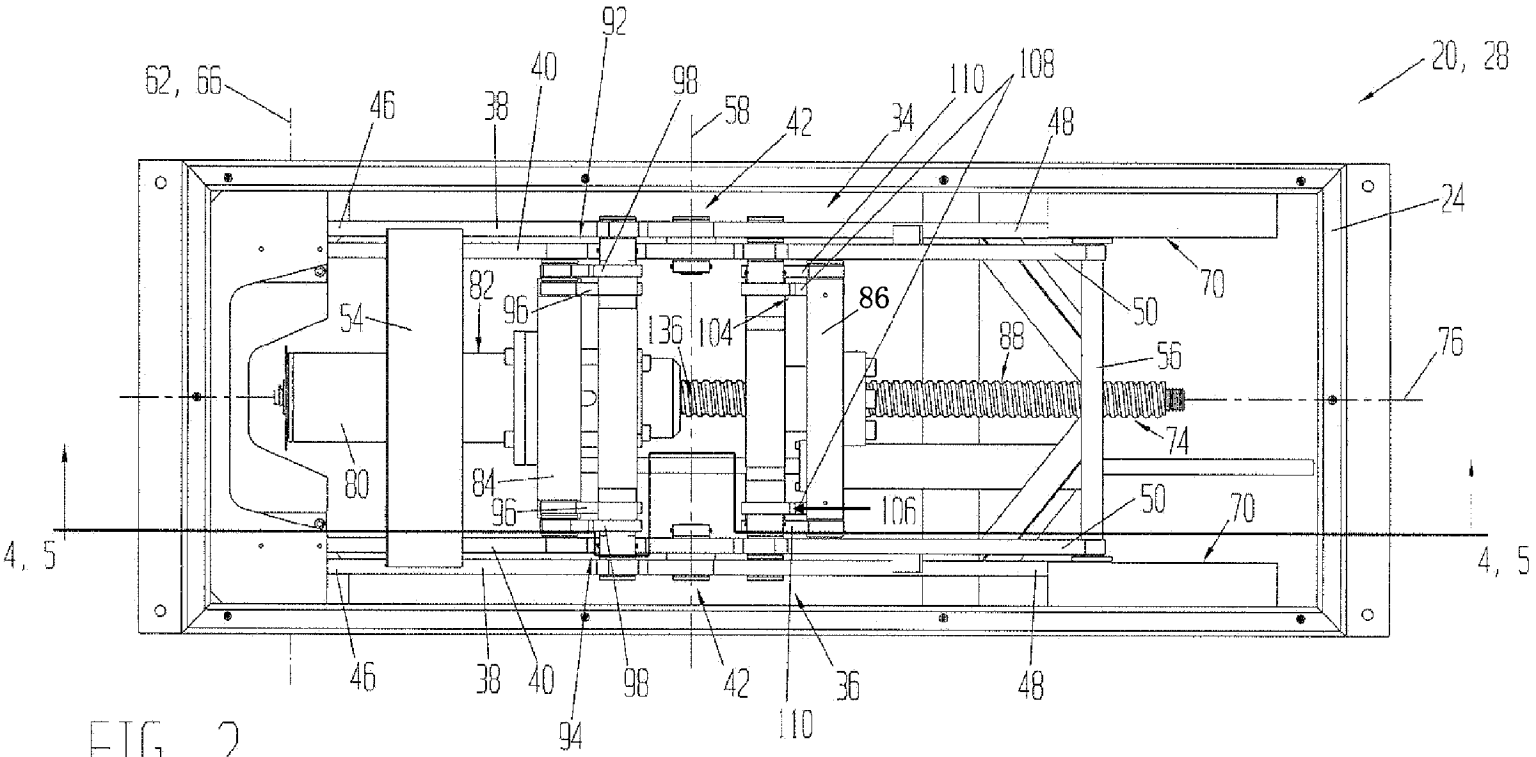
FIG. 2 is a top view of the lift assembly shown in FIG. 1 in an elevated state.
Figure 3:
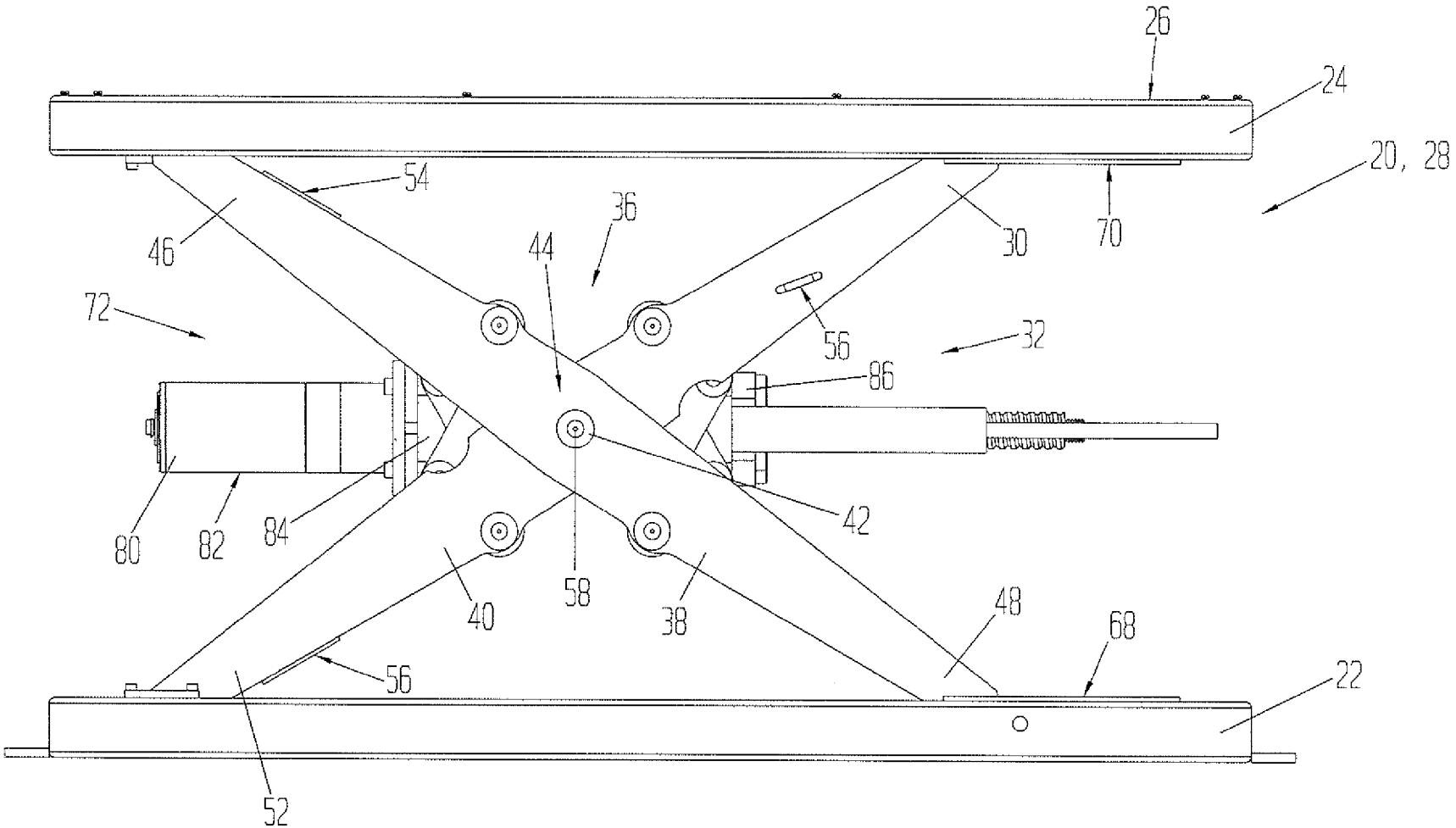
FIG. 3 is a side view of the lift assembly shown in FIG. 1 in an elevated state.
Figure 4:
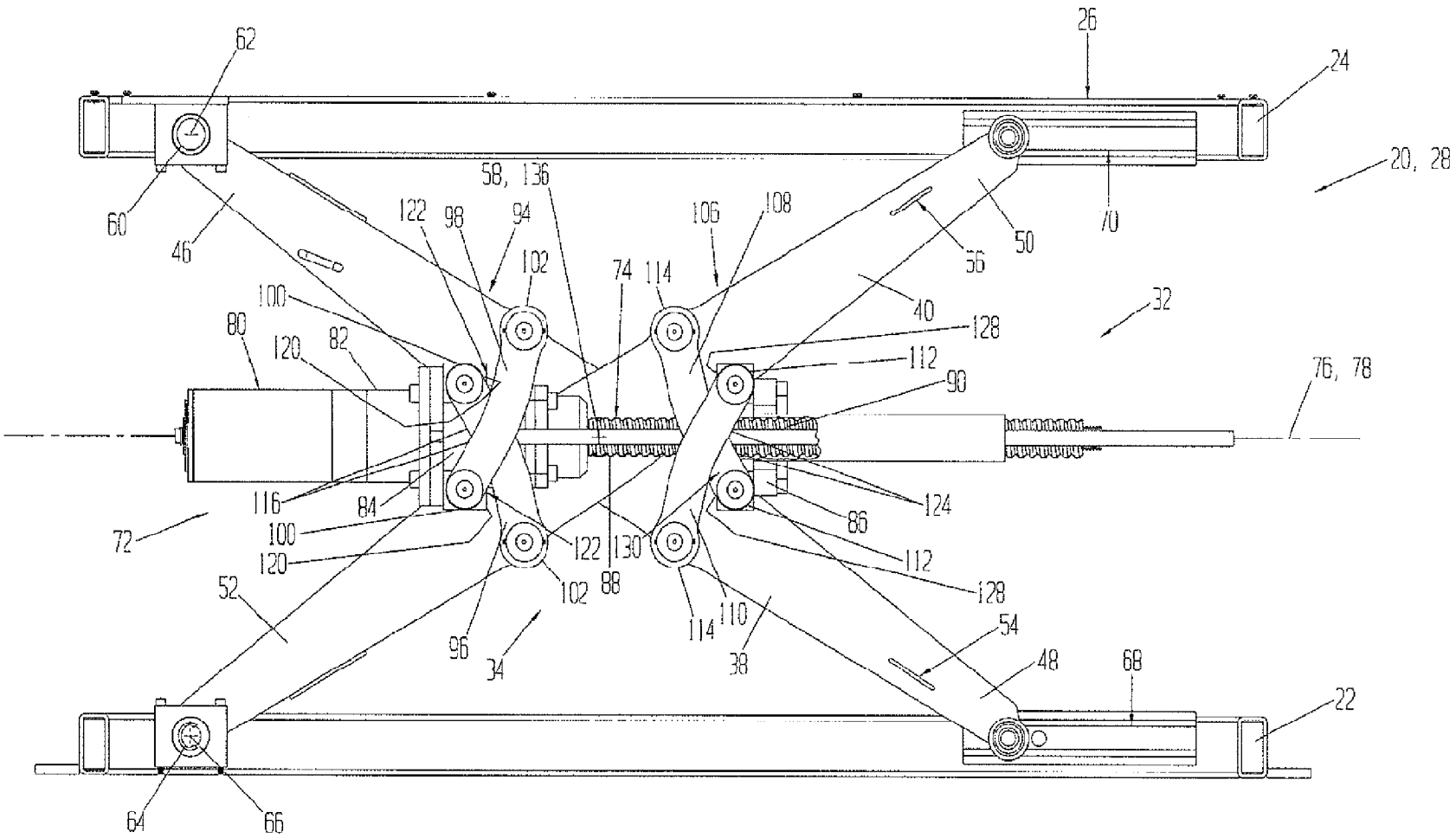
FIG. 4 is a partially fragmented, sectional side view of the lift assembly shown in FIG. 2 along line 4,5-4,5 thereof, in an elevated state showing the orientation of the first and second pairs of links.

While the invention is susceptible to various modifications and alternative forms, a specific embodiment thereof is shown by way of example in the drawings and may herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

Figure 5:
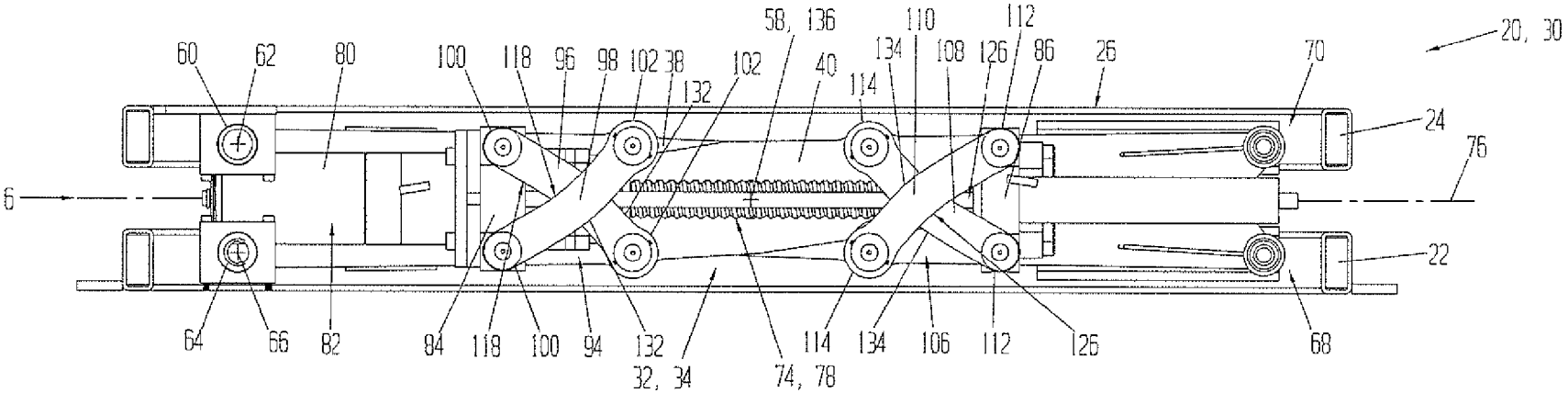
FIG. 5 is a sectional side view of the lift assembly shown in FIG. 2 along line 4,5-4,5 thereof, in a lowered state showing the orientation of the first and second pairs of links.
Figure 6:
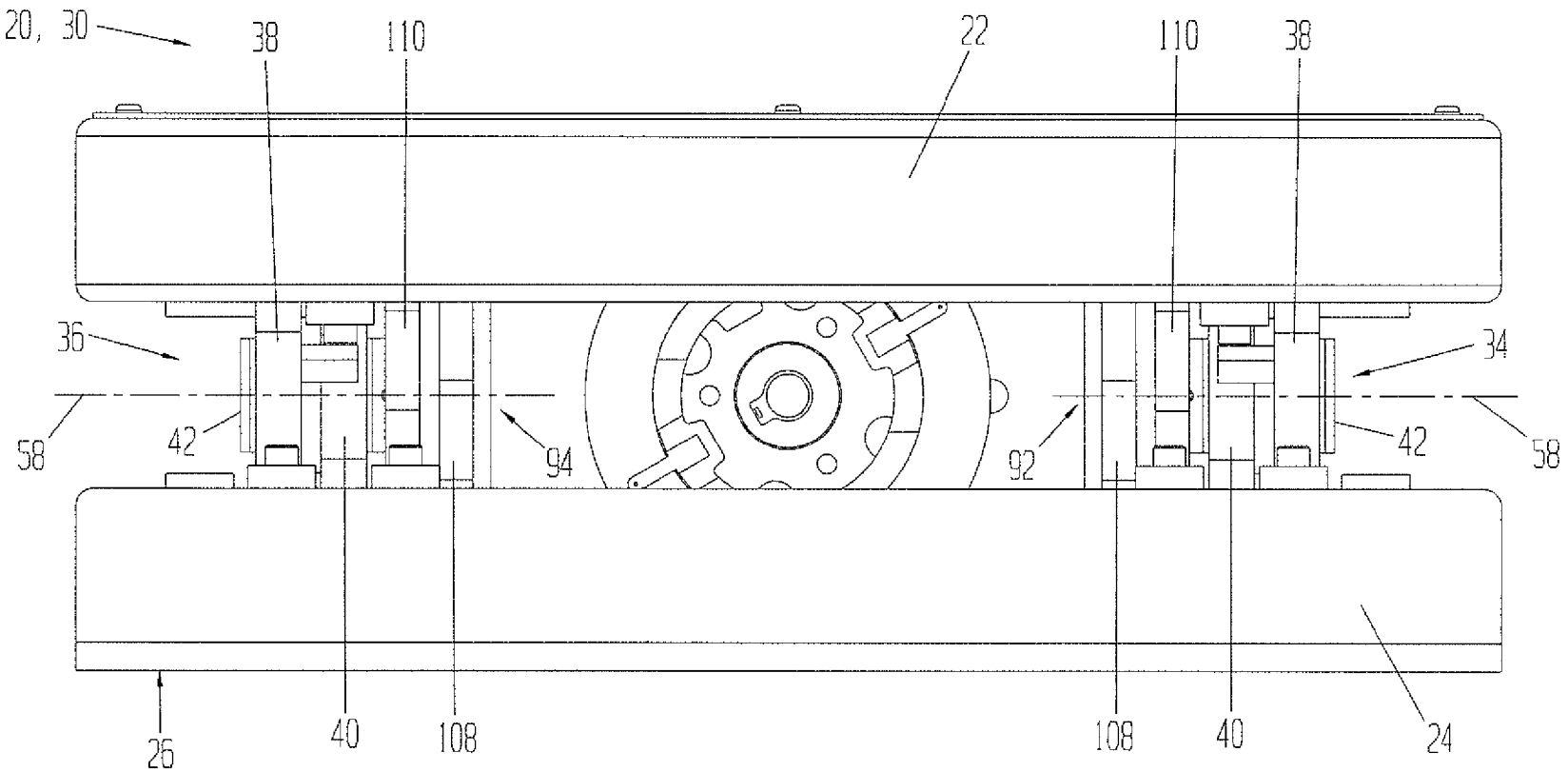
FIG. 6 is an enlarged end view of the lift assembly shown in FIG. 5 in a lowered state.

Referring to FIGS. 1-5, there is shown a first embodiment of a scissor-type lift assembly 20 which has a base 22 and a platform 24, each of which may be made of steel. Platform 24 has upwardly facing supporting surfaces 26. Base 22 and platform 24 may be made of steel. Lift assembly 20 has an extended or elevated state 28 in which the platform and base are distant from each other, and a contracted or lowered state 30 in which the lift assembly base and platform are proximal to each other. FIGS. 1-4 show lift assembly 20 in elevated state 28, and FIGS. 5 and 6 show lift assembly 20 in lowered state 30.

Disposed between and operatively connected to base 22 and platform 24 is scissor arm assembly 32 which includes first pair of crossed scissor arms 34 and second pair of crossed scissor arms 36. Each pair of crossed scissor arms 34, 36 respectively includes an elongate first arm 38 and an elongate second arm 40, which are pivotably connected to each other via a bolted connection 42 at a middle region 44 between their opposite ends. Each first arm 38 has an upper end 46 and an opposite lower end 48, and each second arm 40 has an upper end 50 and a lower end 52. The pairs of crossed scissor arms 34, 36 are substantially identical, but minor images of each other, with their first arms 38 laterally inboard of their second arms 40.

Extending laterally between and rigidly fixed to the two first arms 38 are first braces 54, and extending laterally between and rigidly fixed to the two second arms 40 are second braces 56. Arms 38, 40 and braces 54, 56 may be made of steel. Upper ends 46 and 50 of the respective first arms 38 and second arms 40 engage platform 24, and lower ends 48 and 52 of the respective first arms 38 and second arms 40 engage base 22. The pivotable connections 42 of each of the first and second pairs of crossed scissor arms 34, 36 define laterally-extending pivot axis or central axis 58 of scissor arm assembly.

At its upper end 46, each first arm 38 has a bolted connection 60 to platform 24 which defines pivot axis 62, and at its lower end 52 each second arm 40 has a bolted connection 64 to base 22, which defines pivot axis 66. Base 22 includes substantially horizontally extending guide tracks 68 along which the lower ends 48 of the first arms 38 slidably travel, and platform 24 includes substantially horizontally extending guide tracks 70 along which the upper ends 50 of the second arms 40 slidably travel.

Disposed laterally between its first 34 and second 36 pairs of crossed scissor arms 38, 40, lift assembly 20 further includes a drive screw mechanism 72 that includes a reversibly rotatable shaft 74 having a longitudinal axis 76 that extends in a direction substantially perpendicular to pivot axis 58 of scissor arm assembly 32, with axes 58 and 76 defining a substantially horizontal imaginary plane 78 that remains located between imaginary horizontal planes containing base 22 and platform 24 at all lift assembly positions between its extended and contracted states 28, 30.

Drive screw mechanism 72 includes a reversible drive motor 80, such as a stepper or servo motor, to which shaft 74 is rotatably coupled. Drive screw mechanism 72 includes a housing 82 defining a collar 84 to which motor 80 is fixed, with shaft 74 being rotatable relative to collar 84, but longitudinally fixed relative to collar 84.

Drive screw mechanism further includes a shaft-receiving block 86 through which shaft 74 extends, with shaft 74 and block 86 operatively engaged such that relative rotation therebetween induces relative longitudinal movement therebetween along axis 76. As shown, shaft 74 and block 86 may each be respectively provided with helical screw threads 88, 90 that are directly interengaged with each other to transform their relative rotation into their relative longitudinal movement. Alternatively, shaft 74 and block 86 may form a ballscrew device (not shown) of a type well-known in the art, with each of the shaft 74 and the block 86 provided with corresponding helical ball grooves (not shown) that form a channel through which in which a plurality of balls (not shown) move, the shaft 74 and block 86 being threadedly engaged with each other through the balls and grooves. Relative to axis 76, the balls of such a ballscrew are captured within the axial length of block 86, with block 86 adapted to provide a channel extending between the axial ends of its grooved portion to return the balls from one end of the block's helical groove to the other. Regardless of the type of screw providing threaded engagement between shaft 74 and block 86, the screw pitch is selected to prevent the shaft 74 from being backdriven. That is to say, lift assembly 20 maintains its established when shaft 74 is not being driven by motor 80, regardless of the load exerted on shaft 74 by block 86.

Lift assembly 20 further includes, relative to the first 34 and second 36 pairs of crossed scissor arms 38, 40, a first pair of collar links 92 and a second pair of collar links 94, respectively. In other words, the first pair of collar links 92 is associated with first pair of crossed scissor arms 34, and the second pair of collar links 94 is associated with second pair of crossed scissor arms 36. The two pairs of collar links 92, 94 are identical to each other and located on opposite lateral sides of shaft longitudinal axis 76. Each of the first 92 and second 94 pairs of collar links includes a curved first collar link 96 and a curved second collar link 98, the first 96 and second 98 collar links of each pair of collar links 92, 94 elongate and crossed. Further, the first 96 and second 98 collar links of each pair of collar links 92, 94 are substantially identical, but mirror images of each other relative to shaft longitudinal axis 76.

Relative to each pair of collar links 92, 94, each collar link 96, 98 has a first end 100 and an opposite second end 102, with collar link first ends 100 pivotably attached to collar 84. Relative to each pair of collar links 92, 94, the pivotal connection between collar 84 and the first end 100 of each first collar link 96 is above and vertically aligned with the pivotal connection between collar 84 and the first end 100 of each second collar link 98. Relative to each pair of collar links 92, 94, each collar link second end 102 is pivotably attached to one of a first and second scissor arm 38, 40. Relative to each pair 34, 36 of crossed scissor arms 38, 40, the pivotal connection between its second scissor arm 40 and the second end 102 of the first collar link 96, is below and vertically aligned with the pivotal connection between its first scissor arm 38 and the second end 102 of the second collar link 98.

Lift assembly 20 further includes, relative to the first 34 and second 36 pairs of crossed scissor arms 38, 40, a first pair of block links 104 and a second pair of block links 106, respectively. In other words, the first pair of block links 104 is associated with first pair of crossed scissor arms 34, and the second pair of block links 106 is associated with the second pair of crossed scissor arms 36. The two pairs of block links 104, 106 are identical to each other and located on opposite lateral sides of shaft longitudinal axis 76. Each of the first 104 and second 106 pairs of block links includes a curved first block link 108 and a curved second block link 110, the first 108 and second 110 block links of each pair of block links 104, 106 elongate and crossed. Further, the first 108 and second 110 block links of each pair of block links 104, 106 are substantially identical, but mirror images of each other relative to shaft longitudinal axis 76.

Relative to each pair of block links 104, 106, each block link 108, 110 has a first end 112 and an opposite second end 114, with block link first ends 112 pivotably attached to block 86. Relative to each pair of block links 104, 106, the pivotal connection between block 86 and the first end 112 of each first block link 108 is below and vertically aligned with the pivotal connection between block 86 and the first end 112 of each second block link 110. Relative to each pair of block links 104, 106, each block link second end 114 is pivotably attached to one of a first and second scissor arm 38, 40.

Relative to each pair 34, 36 of crossed scissor arms 38, 40, the pivotal connection between its second scissor arm 40 and the second end 114 of the first block link 108, is above and vertically aligned with the pivotal connection between its first scissor arm 38 and the second end 114 of the second block link 110.

The collar 84 and the block 86 are each spaced from the central pivot axis 58 along shaft longitudinal axis 76. Collar 84 is indirectly coupled to the first 34 and second 36 pairs of scissor arms 38, 40 through the first 92 and second 94 pairs of collar links 96, 98, the collar links 96, 98 crossed between their first 100 and second 102 ends. Block 86 is similarly indirectly coupled to the first 34 and second 36 pairs of scissor arms 38, 40 through the first 104 and second 106 pairs of block links 108, 110, the block links 108, 110 crossed between their first 112 and second 114 ends.

Between the opposed first 100 and second 102 ends of each collar link 96, 98 extends an edge 116 that faces away from pivot axis 58, edge 116 defining a recess 118 in its respective collar link 96, 98. A portion 120 of collar 84 that would otherwise interfere with the movement of a collar link 96, 98 were edge 116 instead straight, is now provided with clearance 122 when portion 120 and that collar link are in closest proximity throughout the entire range between the lift assembly extended 28 and contracted 30 states, which is the depicted embodiment occurs in extended state 28. Similarly, Between the opposed first 112 and second 114 ends of each block link 108, 110 extends an edge 124 that faces away from pivot axis 58, edge 124 defining a recess 126 in its respective block link 108, 110. A portion 128 of block 86 that would otherwise interfere with the movement of a block link 108, 110 were edge 124 instead straight, is now provided with clearance 130 when portion 128 and that block link are in closest proximity throughout the entire range between the lift assembly extended 28 and contracted 30 states.

In all positions of lift assembly 20 in and between its extended 28 and contracted 30 states, edge 116, 124 of each respective link 96, 98, 108, 110, extends away from pivot axis 58 from that link's second end 102, 114 to its first end 100, 112. Edges 116, 124 may be curved or arcuate as shown, or may be formed of straight segments, either configuration of an edge 116, 124 defining the recess 118, 126 that provides the resulting clearance 122, 130. The opposed edge 132, 134 of each collar or block link extending between its first 100, 112 and second 102, 114 ends, that faces toward pivot axis 58 may complement the recess-defining edge 116, 124, the two opposed edges 116, 124, 132, 134 defining each respective link 96, 98, 108, 110 as a substantially curved member, as shown.

Shaft longitudinal axis 76 defines opposite longitudinally outward directions originating at the point 136 therealong where it crosses the central pivot axis 58. Respective to each link 96, 98, 108, 110, its first end 100, 112 pivotal connection to collar 84 or block 86 is further longitudinally outward than its second end 102, 114 pivotal connection to a first 38 or second 40 scissor arm in both the extended state 28 and in the contracted state 30.

As to a further discussion of the manner of usage and operation of the present invention, the same should be apparent from the above description. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A lift assembly comprising:

a base;

a platform, said lift assembly having extended and contracted states, said platform at a greater distance from said base in said extended state than in said contracted state;

a pair of scissor arms each having opposed first and second ends with said scissor arms being pivotably connected to each other about a central axis located between respective first and second ends, said first end of each scissor arm being coupled to said base and said second end of each scissor arm being coupled to said platform;

a drive screw mechanism comprising a shaft defining a longitudinal axis, a drive motor rotatably coupled to said shaft, a block threadedly engaged with said shaft and having longitudinal movement relative to said shaft urged by rotation of said shaft, and a collar relative to which said shaft is rotatable, said collar longitudinally fixed relative to said shaft; and first and second pairs of links with each link having opposed first and second link ends and an edge extending between said first and second link ends, with said edge facing away from said central axis and defining a recess in said link;

said collar and said block each spaced from said central axis and indirectly coupled to both of said scissor arms through said first and second pairs of links, each of said links of said first and second pairs of links being crossed between said first and second link ends, and each link of said first pair of links is pivotably attached to said collar at said first link end and pivotably attached to one of said scissor arms at said second link end, and each link of said second pair of links is pivotably attached to said block at said first link end and pivotably attached to one of said scissor arms at said second link end.

2. The lift assembly of claim 1, wherein said edge is arcuate in shape.

3. The lift assembly of claim 2, wherein each link is curved between said first and second link ends.

4. The lift assembly of claim 1, wherein with said lift assembly in said extended state, said edge extends away from said central axis from said second link end to said first link end.

5. The lift assembly of claim 4, wherein with said lift assembly in said contracted state, said edge extends away from said central axis from said second link end to said first link end.

6. The lift assembly of claim 1, wherein said longitudinal axis is substantially perpendicular to said central axis, said longitudinal axis defining opposite longitudinally outward directions originating at a point therealong where said longitudinal axis crosses said central axis, wherein said first link end of each link of said first pair of links and said first link end of each link of said second pair of links form a first pivotal connection and said second link end of each link of said first pair of links and said second link end of each link of said second pair of links form a second pivotal connection, and wherein, respective to each said link, said first pivotal connection being further longitudinally outward than said second pivotal connection in said contracted state.

7. The lift assembly of claim 6, wherein said first pivotal connection is further longitudinally outward than said second pivotal connection in said extended state.

8. The lift assembly of claim 1, wherein said motor is fixed to said collar.

9. The lift assembly of claim 1, wherein with said lift assembly in said contracted state, said edge extends away from said central axis from said second link end to said first link end.

10. The lift assembly of claim 1, wherein a portion of said drive screw mechanism is disposed between and spaced from said first and second pairs of links, and said portion of said drive screw mechanism is further disposed between said first and second link ends in said extended state.

* * * * *